US009646434B2

(12) United States Patent
Hadizad

(10) Patent No.: US 9,646,434 B2
(45) Date of Patent: May 9, 2017

(54) METHOD AND SYSTEM FOR CONTROLLING ACCESS TO A RESTRICTED LOCATION

(71) Applicant: Motorola Mobility LLC, Libertyville, IL (US)

(72) Inventor: Peyman Hadizad, Redwood City, CA (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 0 days.

(21) Appl. No.: 14/050,742

(22) Filed: Oct. 10, 2013

(65) Prior Publication Data

US 2015/0102907 A1 Apr. 16, 2015

(51) Int. Cl.
*G07C 9/00* (2006.01)
*G08C 17/02* (2006.01)

(52) U.S. Cl.
CPC ..... *G07C 9/00007* (2013.01)

(58) Field of Classification Search
CPC .. G07C 9/00007; G07C 9/00; G07C 9/00174; G07C 9/00309; G07C 9/00015; G07C 9/00031; G07C 9/00103; G07C 9/00111; G07C 9/00119; G07C 9/00134; G07C 9/00571; G07C 2009/00865; G07C 9/00904; G08C 17/02; H04W 12/00; H04W 12/06
USPC ..... 340/5.1, 5.2, 5.21, 5.26, 5.61, 5.64, 5.7, 340/5.71, 5.72, 5.73
See application file for complete search history.

(56) References Cited

U.S. PATENT DOCUMENTS 7,471,199 B2 12/2008 Zimmerman et al.
7,979,714 B2 7/2011 Borsa et al.
8,191,161 B2 5/2012 Sanchez et al.
(Continued)

FOREIGN PATENT DOCUMENTS

WO 2009148802 A1 12/2009

OTHER PUBLICATIONS

Andy Greenberg, "Google Glass Hacked with QR Code Photobombs", http://www.forbes.com/sites/andygreenberg/2013/07/17/google-glass-hacked-with-qr-code-photobombs/, Jul. 17, 2013, 5 pages.
(Continued)

*Primary Examiner* — Brian Wilson
(74) *Attorney, Agent, or Firm* — Morris & Kamlay LLP

(57) ABSTRACT

The present disclosure describes techniques for controlling access a restricted location (114) as well as a system (100) for doing so. According to various implementations, a potential entrant to the restricted location needs to transmit two values to an access authorization device (108) located at the perimeter (112) of the restricted location in order to gain access. In one implementation, the system provides an authentication code to a first device (116) (e.g., a smartphone) via wireless communication link (120) (e.g., over a cellular network) and displays a visual image (127) with an embedded access code at a display device (104). The second device (118), which is securely paired with the first device, captures the image and sends the image data to the first device. Using the authentication code and the access code, the first device derives the two values to gain access to the restricted location.

19 Claims, 4 Drawing Sheets

(56) References Cited

U.S. PATENT DOCUMENTS

| | | | | |
|---|---|---|---|---|
| 2005/0199723 | A1* | 9/2005 | Lubow | G06K 1/18 235/462.01 |
| 2007/0174472 | A1* | 7/2007 | Kulakowski | G06F 21/31 709/229 |
| 2012/0280789 | A1* | 11/2012 | Gerhardt | G07C 9/00309 340/5.61 |
| 2013/0059598 | A1* | 3/2013 | Miyagi | H04W 4/023 455/456.1 |
| 2013/0117078 | A1* | 5/2013 | Weik et al. | 705/13 |
| 2013/0214902 | A1* | 8/2013 | Pineau | G06F 21/32 340/5.61 |
| 2013/0257590 | A1* | 10/2013 | Kuenzi et al. | 340/5.65 |
| 2014/0158769 | A1* | 6/2014 | Powell | G06K 7/10811 235/462.06 |

OTHER PUBLICATIONS

Google, "Pairing Glass to your Phone or Tablet", https://supportgoogle.com/glass/answer/3064189?hl=en, 2013, 2 pages.

* cited by examiner

METHOD AND SYSTEM FOR CONTROLLING ACCESS TO A RESTRICTED LOCATION

TECHNICAL FIELD

The present disclosure relates generally to physical access and, more particularly, to controlling access through wireless media and visual media.

BACKGROUND

Many corporate and government entities require employees to present security cards or badges to an electronic reader in order to enter restricted locations (e.g., office buildings, corporate campuses). Such cards and badges typically have a magnetic stripe or a near-field communication ("NFC") chip that contains a security code. When the card or badge is presented (e.g., by swiping or touching), the reader obtains the security code and transfers it to a security system. If the code is correct, then the security system permits the employee to gain access to the facility.

In the past couple of years, corporations have been experimenting with the use of smartphones in lieu of cards and badges. Security in each of these schemes can be compromised, however, if someone steals the badge, card, or smartphone.

DRAWINGS

While the appended claims set forth the features of the present techniques with particularity, these techniques may be best understood from the following detailed description taken in conjunction with the accompanying drawings of which:

FIG. 1 shows a system configured in accordance with an embodiment of the disclosure.

FIG. 2 describes steps carried out according to embodiments of the disclosure.

DETAILED DESCRIPTION

Figure 1:
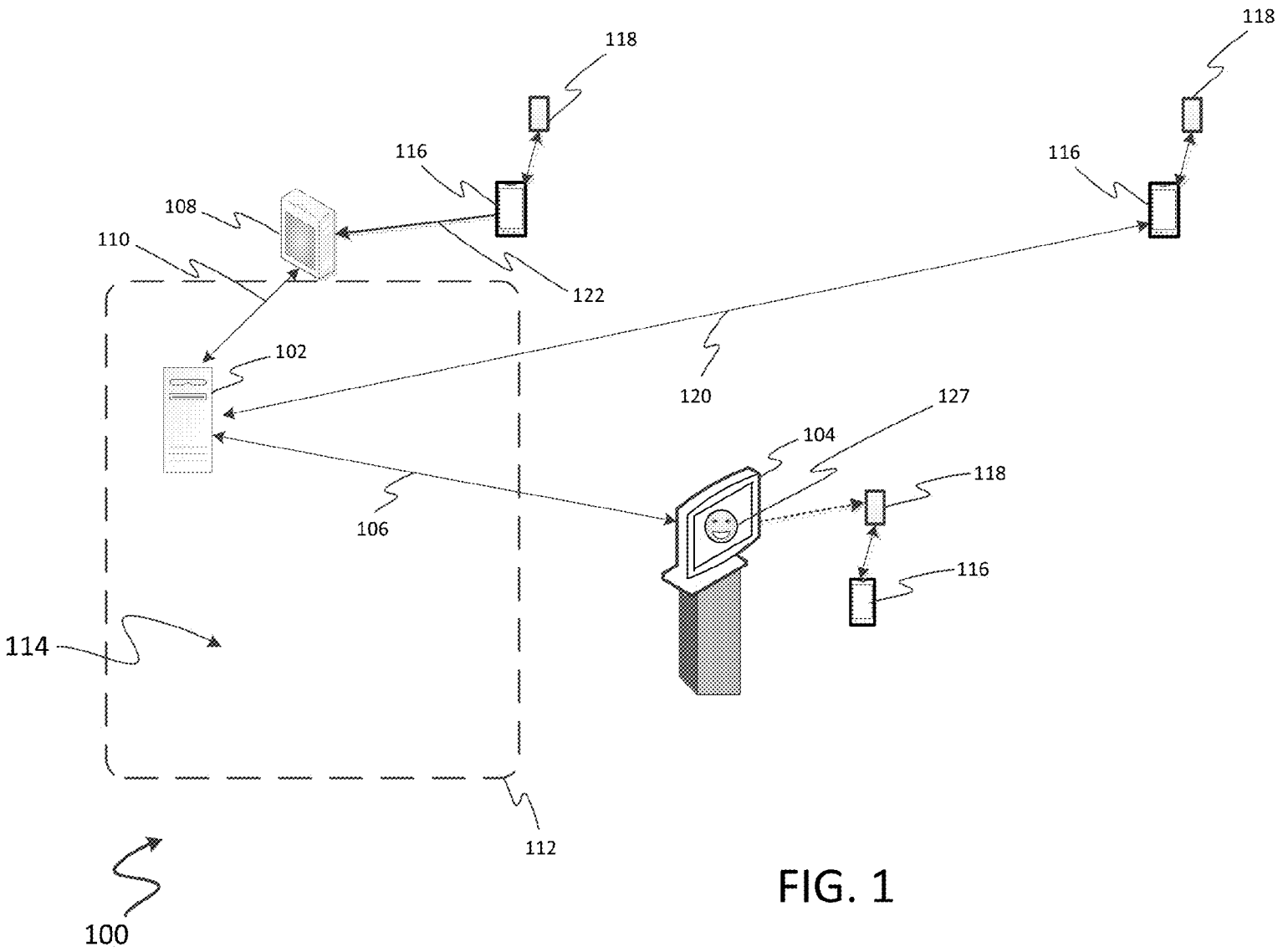

Turning to the drawings, wherein like reference numerals refer to like elements, techniques of the present disclosure are illustrated as being implemented in a suitable environment. The following description is based on embodiments of the claims and should not be taken as limiting the claims with regard to alternative embodiments that are not explicitly described herein.

The present disclosure describes techniques for controlling access to a restricted location as well as a system for doing so. According to various embodiments, a potential entrant to a restricted location transmits two values to an access authorization device located at the perimeter of the restricted location in order to gain access. According to an embodiment, the system provides an authentication code to a first device (e.g., a smartphone) via wireless communication (e.g., over a cellular network) and displays a visual image at a display device. A second device, which is securely paired with the first device, captures the visual image and sends the visual image data, or an access code derived from the visual image data, to the first device. The first device derives the access code from the image if the visual image data was sent. The potential entrant then brings the first device near the access authorization device so that the first device can transmit one ore more values derived from the two codes to the access authorization device. If the values are correct, the system allows the individual to enter (e.g., by unlocking a door).

By providing each code to a separate device using different transport mechanisms, the system reduces the chance of a security breach, because a potential thief would need to steal both the first and the second device in order to obtain access to the codes.

FIG. 1 depicts an embodiment of the system. The system 100 includes a computing device 102 that communicates with a display device 104 over a first communication link 106 and communicates with an access authorization device 108 over a second communication link 110. The first and second communication links 106 and 110 may be wired, wireless, or a combination thereof, and may overlap with one another. The access authorization device 108 is located at the perimeter 112 of a restricted location 114. The display device 104 is located proximate to the access authorization device 108 and outside the perimeter 112 of the restricted location 114.

In this context, the distance connoted by "proximate" depends on the size of the restricted location. For example, if the restricted location is a cabinet, then anywhere in the room can be proximate. If the restricted location is a room, then anywhere in the building (or the same floor of the building; or the same quadrant on the same floor) can be proximate. If the restricted location is building-sized, then anywhere on the building's land can be proximate. If the restricted location is a campus (multiple buildings), then anywhere in the campus's land can be proximate.

FIG. 1 also depicts a first device 116 and a second device 118. Possible implementations of the first device 116 include a mobile device such as a cell phone, laptop computer, or wearable wireless accessory. The second device 118 is capable of capturing still or moving images and wirelessly transmitting them, or data derived from them, to the first device 116. Possible implementations of the second device 118 include a wearable video camera such as Google Glass™. The first device 116 and second device 118 are securely paired with one another by way of a known technology such as Bluetooth®. Thus, the second device 118 is able to transmit data to the first device 116 in such a way that the first device 116 has a high level of confidence that the source of the data is, in fact, the second device 118.

According to an embodiment, the computing device 102 is capable of generating an authentication code and an access code using one or more well-known techniques. In some embodiments, the computing device 102 does not generate authentication codes but instead receives them from an external source. It is also capable of transmitting the authentication code to the first device 116 over a first wireless radio link 120. Possible implementations of the first wireless link 120 include a wireless wide area network, a wireless local area network, a wireless personal area network, a cellular network, and the Internet.

In an embodiment of the disclosure, the computing device 102 can update the authentication code and the access code as needed or on a periodic basis. For example, if the computing device 102 has a first authentication code and a predetermined time interval passes, the computing device 102 can push out a different, second authentication code to the first device 116 via the first wireless link 120. The first device 116 then uses the second authentication code until the next update (i.e., until the computing device 102 generates a third authentication code).

In an embodiment, the computing device 102 is capable of generating an image 127 based on the access code. It transmits the image 127 to the display device 104 over the communication link 106. Alternatively, the computing device 102 may transmit the access code to the display device 104 and the display device 107 may generate the image 127 based on the access code. The display device 104 displays the image 127 on a screen in response to the appropriate user input. The second device 118, when in visual range of the display device 104, can capture the image 127 and transmit the image data to the first device 116 over a secure communication link such as Bluetooth®. After the first device 116 receives the image data, it can determine the access code. Alternatively, the second device 118 may have a processor that allows it to determine the access code from the image data and then send the access code to the first device 116 instead of sending the image data. From both the authentication code and the access code, the first device 116 can derive at least one value for transmission to the access authorization device 108. In this embodiment and for ease of explanation, two values are transmitted to the authorization device 108.

Referring still to FIG. 1, the access authorization device 108 is capable of receiving values derived from the first and second codes from the first device 116 via the second wireless link 122. Similarly, the first device 116 is capable of transmitting data over short distances to the access authorization device 108 over the second wireless link 122. Possible implementations of the second wireless link 122 include Bluetooth®, NFC, and WiFi. The access authorization device 108 may communicate with the computing device 102 via communication link 110 to verify the validity of the values.

Figure 2:
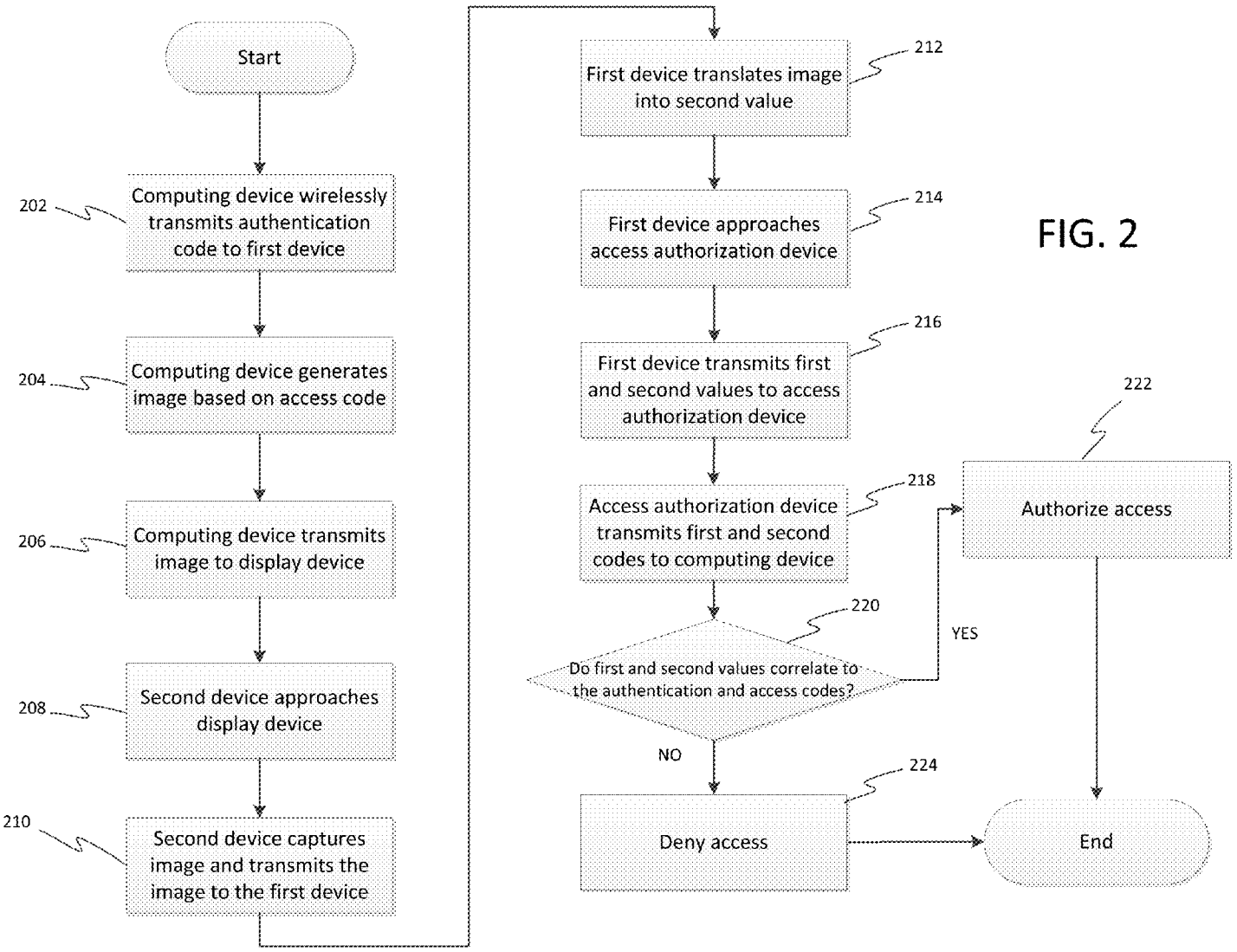

Referring to FIG. 2, the computing device 102 controls access to the restricted location 114 according to an embodiment of the disclosure as follows. At block 202, the computing device 102 wirelessly transmits an authentication code to the first device 116 via the first wireless radio link 120. The first device 116 stores the authorization code as a first value.

The first device 116 can be in any location when it receives the authentication code, including at the owner's home or workplace. The first device 116 and the second devices 118 need not be paired when the first device 116 receives the authentication code.

At block 204, the computing device 102 generates an image based on the access code. Possible types of images include an alphanumeric code, a visual representation of an object, a visual representation of a person, a pattern, a bar code, and a QR code. At block 206, the computing device 102 transmits the image to the display device 104, which then displays the image. As an alternative to blocks 204, 206, the computing device 102 may transmit the access code to the display device 104 and then the display device 104 may generate an image based on the received access code.

At block 208, the second device 118 approaches the display device 104 (e.g., being moved into position in front of the display device 104 by a person wanting to enter the restricted area 114). At block 210, the second device 118 captures the image on the display device 104 and sends the image to the first device 116. Alternatively, the second device 118 may process the image data and send the access code to the first device 116. At block 212, the first device 116 translates the image data or access code into a second value. At block 214, the first device 116 approaches the access authorization device 108, (e.g., carried there by an individual wishing to enter the restricted location 114). Blocks 202, 204, 206, 208, 210, 212, and 214 may be performed in any order prior to block 216.

At block 216, the first device 116 transmits the first value and the second value to the access authorization device 108 over the second wireless link 122 using, for example, Bluetooth®, NFC, or WiFi. At block 218, the access authorization device 108 transmits the two values based on the first and second codes to the computing device 102 over the second communication link 110. At decision block 220, the computing device 102 determines whether to grant access to the restricted location 114 based on the relationship between the first value and the authorization code, and on the relationship between the second value and the access code. In one embodiment, the relationships are mathematical. For example, if the first value equals the authentication code and the second value equals the access code, then the computing device 102 authorizes access to the restricted location 114 at block 222. More complicated mathematical relationships, such as hashes with a third value, XORs, or other functions and formulas may be used in lieu of the simple match described here. The computing device 102 may also carry out an action based on this authorization, such sending a signal to unlock a door or activating a visual or audible signal, or other type of alert, at a guard station. If the first value does not equal the authentication code or the second value does not equal the access code, then computing device 102 denies access at block 224.

Figure 3:
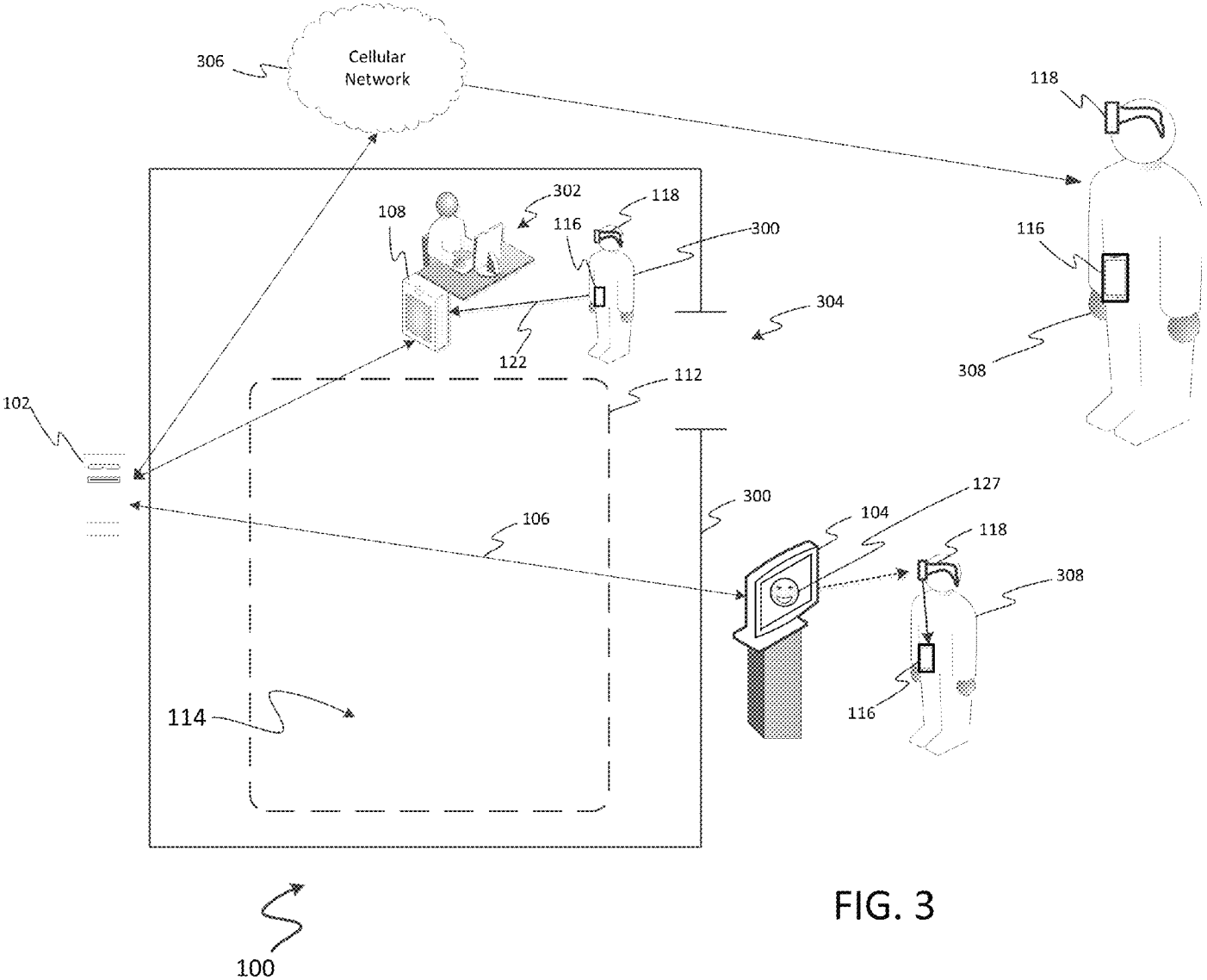
FIG. 3 shows the system of FIG. 1 deployed in a corporate environment.

FIG. 3 depicts a scenario that illustrates various embodiments of the disclosure. In this scenario, the system 100 is deployed in a building 300 of a corporation. The restricted location 114 is situated within the building 300, with the perimeter 112 extending up to a guard station 302 located near a doorway 304 of the building 300. The access authorization device 108 is located at the guard station 302, while the display device 104 is located outside of the building 300 near the doorway 304. The computing device 102 is located off-site in this scenario.

Referring still to FIG. 3, the first device 116 is a smartphone and the second device 118 is a wearable device having an integrated camera that is securely paired with the first device 116 using Bluetooth®. The first device 116 and the computing device 102 communicate with one another over a cellular network 306.

In this scenario, the process for controlling access is the same as that described in conjunction with FIG. 2. In a more specific embodiment, however, the actions carried out at blocks 208, 210, 214, and 216 of FIG. 2 are as follows. At block 208, an employee 308 of the corporation brings the second device 118 to the display device 104 and activates the display device 104 (e.g., by pressing buttons on the display device). In response, the display device 104 displays the image 127. The employee 308 positions the second device 118 so that it can capture the image 127. If the second device is a wearable accessory with a camera, such as Google Glass™, then the employee 308 need only to look at the display to capture the image 127. At block 210, the second device 118 captures the image 127 and transmits data regarding the image to the first device 116.

At block 214, the employee 308 approaches the guard station 302. At block 216, the first device 116, either automatically or in response to user input, transmits the first and second values to the access authorization device 108 via wireless link 122. The remainder of the actions are carried according to the flowchart 200 occur as discussed in conjunction with FIG. 2.

Figure 4:
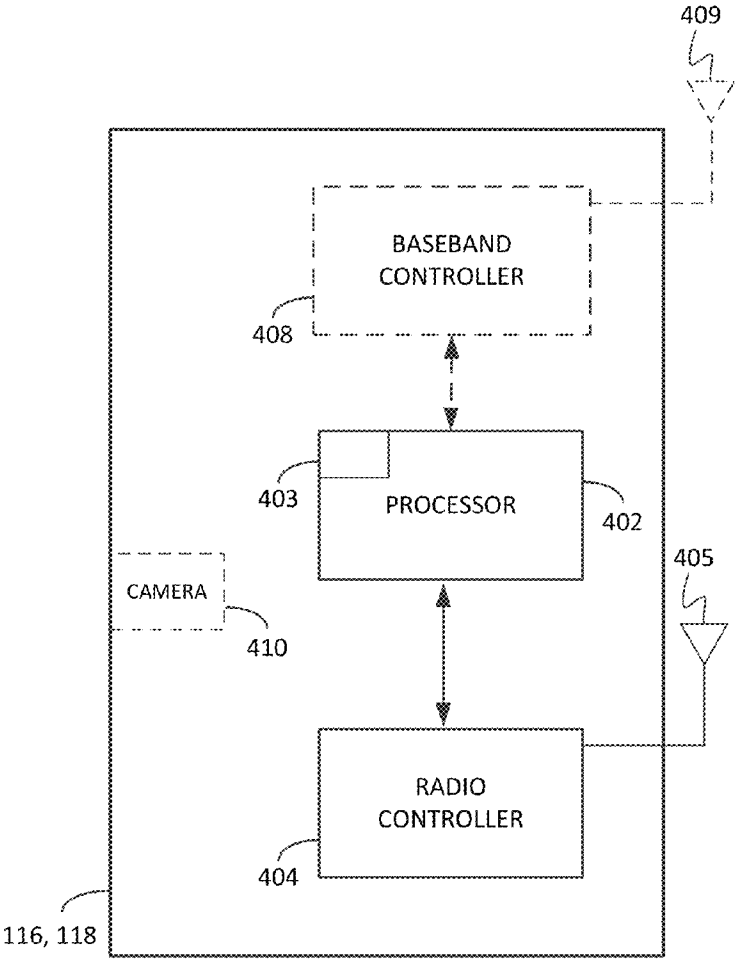
FIG. 4 shows a first or second device configured according to an embodiment.

FIG. 4 depicts the first device 116 or the second device 118 according to an embodiment. The first device 116 and the second device 118 each include a processor 402, a radio controller 404 communicatively linked to the processor 402, and a first antenna 405 electrically coupled to the radio controller 404. The processor 402 includes a memory 403. The memory 403 may also be external to the processor 402. The radio controller 404 may also be implemented in a variety of ways, including as a Bluetooth® controller and as a WiFi controller. If the second device 118 processor 402 supports determining an access code from captured image data, the second device 118 may transmit the access code to the first device 116 instead of transmitting the image data.

The first device 116 includes a baseband controller 408 that is electrically coupled to a second antenna 409. The second device 118 may not include a baseband controller, but does include a camera 410. Conversely, the first device 116 does not necessarily have a camera. Each of the elements depicted in FIG. 4 are well-known in the art.

Figure 5:
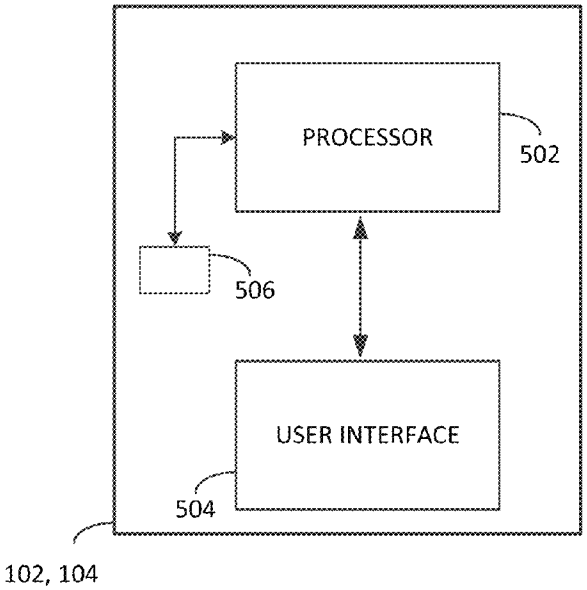
FIG. 5 shows a computing or display device configured according to an embodiment.

FIG. 5 depicts the computing device 102 and the display device 104 according to an embodiment. The computing device 102 and display device 104 each have a processor 502, a user interface 504, and a memory 506. The processor 502 of the computing device 102 may select authentication codes and access codes for the system. The computing device 102 or the display device 104 may create an image from using one or more access codes. Each of these elements is well-known in the art.

In view of the many possible embodiments to which the principles of the present discussion may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

The invention claimed is:

1. A method for controlling access to a restricted location comprising:

wirelessly transmitting an authentication code to a first mobile device;

generating an image based on an access code;

transmitting the image from a computing device to a display device, located outside a perimeter of the restricted location, to be displayed to a second mobile device, a mobility of the second mobile device independent of a mobility of the first mobile device, the second mobile device configured to wirelessly transmit the image over a securely paired wireless connection to the first mobile device;

the display device different from the first mobile device, the display device different from the computing device;

receiving a first value and a second value from the first mobile device via an access authorization device located at the perimeter; and determining whether to grant access to the restricted location based on a relationship between the first value and the authentication code, and on a relationship between the second value and the access code.

2. The method of claim 1 further comprising:

unlocking an entry point based on the determining whether to grant access to the restricted location.

3. The method of claim 1 further comprising:

generating an alert based on the determining whether to grant access to the restricted location.

4. The method of claim 1 wherein the wirelessly transmitting the authentication code to the first mobile device is performed using a wireless wide area network, a wireless local area network, a wireless personal area network, a cellular network, or the Internet.

5. The method of claim 1 wherein the wirelessly transmitting the authentication code to the first mobile device comprises transmitting, at a beginning of a time interval, a first code to be used as the authentication code, the method further comprising:

at an end of the time interval, transmitting a second code to be used as the authentication code, wherein the first code does not equal the second code.

6. The method of claim 1 wherein the determining whether to grant access comprises granting or denying access to the restricted location based on:

a mathematical relationship between the first value and the authentication code; and a mathematical relationship between the second value and the access code.

7. The method of claim 1 wherein the image is selected from a group consisting of: an alphanumeric code, a visual representation of an object, a visual representation of a person, a pattern, a bar code, and a QR code.

8. The method of claim 1 wherein the wirelessly transmitting the authentication code to the first mobile device occurs when the first mobile device is outside the restricted location.

9. A computing device configured to:

transmit an authentication code to a first mobile device via a wireless network;

generate an image based on an access code;

transmit the image from the computing device to a display device, located outside a restricted location, to be displayed to a second mobile device, a mobility of the second mobile device independent of a mobility of the first mobile device, the second mobile device configured to wirelessly transmit the image over a securely paired wireless connection to the first mobile device, the display device different from the first mobile device, the display device different from the computing device;

receive one or more values from the first mobile device via an access authorization device located at a perimeter of the restricted location; and determine whether to grant access to the restricted location based on a relationship between the one or more values, the access code, and the authentication code.

10. The computing device of claim 9, wherein the computing device is configured to transmit the authentication code by transmitting, at a beginning of a time interval, a first code to be used as the authentication code, and by transmitting, at an end of the time interval, a second code to be used as the authentication code, wherein the first code does not equal the second code.

11. The computing device of claim 9, wherein the relationship between the one or more values, the access code, and the authentication code includes a first mathematical relationship between a first value and the access code and a second mathematical relationship between a second value and the authentication code.

12. The computing device of claim 9, wherein the image is a visual representation of a person.

13. The computing device of claim 9, wherein the computing device is configured to transmit the authentication code over a wireless link, is configured transmit the image over a first communication link, and is configured to receive one or more values over a second communication link.

14. A system for granting access to a restricted location comprising:

a computing device configured to:

transmit an authentication code to a first mobile device via a wireless radio network;

generate an image based on an access code; and determine whether to grant access to the restricted location based on a relationship between one or more values, the access code, and the authentication code;

a display device located at the restricted location, different from the first mobile device, and configured to:

receive the image from the computing device; and display the image to a second mobile device, a mobility of the second mobile device independent of a mobility of the first mobile device, the second mobile device configured to wirelessly transmit the image over a securely paired wireless connection to the first mobile device; and an access authorization device located at a perimeter of the restricted location and configured to:

receive the one or more values from the first mobile device via a wireless medium; and provide the one or more values to the computing device.

15. The system of claim 14 wherein the wireless medium is selected from a group consisting of a near field communication medium, a personal area network medium, and a local area network medium.

16. The system of claim 14, wherein the computing device is configured to transmit the authentication code by transmitting, at a beginning of a time interval, a first code to be used as the authentication code, and by transmitting, at an end of the time interval, a second code to be used as the authentication code, wherein the first code does not equal the second code.

17. The system of claim 14, wherein the relationship between the one or more values, the access code, and the authentication code includes a first mathematical relationship between a first value and the access code and a second mathematical relationship between a second value and the authentication code.

18. The system of claim 14, wherein the image is a visual representation of a person.

19. The system of claim 14, wherein the access authorization device is configured to receive the one or more values via a wireless link and is configured to provide the one or more values over a communication link.

* * * * *